United States Patent [19]

Simko

[11] Patent Number: 4,715,585

[45] Date of Patent: Dec. 29, 1987

[54] METHOD AND APPARATUS FOR FORMING LADLE WELL BLOCKS

[76] Inventor: Joseph Simko, 6303 New Jersey, Hammond, Ind. 46323

[21] Appl. No.: 909,822

[22] Filed: Sep. 19, 1986

Related U.S. Application Data

[63] Continuation-in-part of Ser. No. 774,090, Sep. 9, 1985, abandoned.

[51] Int. Cl.[4] ..... C21C 5/44

[52] U.S. Cl. ..... 266/273; 266/281; 264/30

[58] Field of Search ..... 266/45, 44, 281, 273, 266/272; 264/30; 222/597, 600

[56] References Cited

U.S. PATENT DOCUMENTS

| | | | |
|---|---|---|---|
| 3,197,824 | 8/1965 | Dolenic et al. | 222/600 |
| 3,511,261 | 5/1970 | Bick et al. | 222/600 |
| 3,944,116 | 3/1976 | Danieli | 266/273 |
| 4,037,762 | 7/1977 | Ruckstuhl | 222/600 |
| 4,116,421 | 9/1978 | Rowe | 266/45 |
| 4,368,834 | 1/1983 | Daussan et al. | 222/597 |
| 4,534,730 | 8/1985 | Kraus | 266/281 |

FOREIGN PATENT DOCUMENTS

| | | | |
|---|---|---|---|
| 1581058 | 12/1980 | United Kingdom | 222/597 |
| 261421 | 1/1970 | U.S.S.R. . | |
| 424716 | 4/1974 | U.S.S.R. . | |
| 992193 | 2/1983 | U.S.S.R. . | |

*Primary Examiner*—L. Dewayne Rutledge
*Assistant Examiner*—S. Kastler
*Attorney, Agent, or Firm*—Richard G. Kinney

[57] ABSTRACT

Apparatus and method for filling the well of a molten metal ladle or like vessel with a pre-selected charge of disposable refractory sand is disclosed. The apparatus includes a disposable can positioned above and in the blocking and at the top of the well. The can includes a plurality of apertures spaced around said can. The apparatus includes a unit hopper that is filled with a preselected charge of sand and is suspended from an overhead crane and maneuvered by crane controls from a safe distance. The hopper unit includes latches for releasably holding the can at its bottom and a trigger mechanism for discharging the sand in response to the seating of the can on a surface and the lowering of the hopper unit through the can. The operator may charge the hopper with sand, latch the can to the bottom of the apparatus, maneuver it into and over the ladle to the well and lower it so that the can is seated above the well. By continuing to lower the crane, the unit automatically releases the can therefrom and triggers the discharge of the sand from the hopper through the unit and into the well. The sand flows therein to fill the well and the bottom of the can. The sand continues to mound in the can and to flow out through its apertures to crown the outside of the can. The operator then raises and withdraws the hopper unit from the ladle.

11 Claims, 17 Drawing Figures

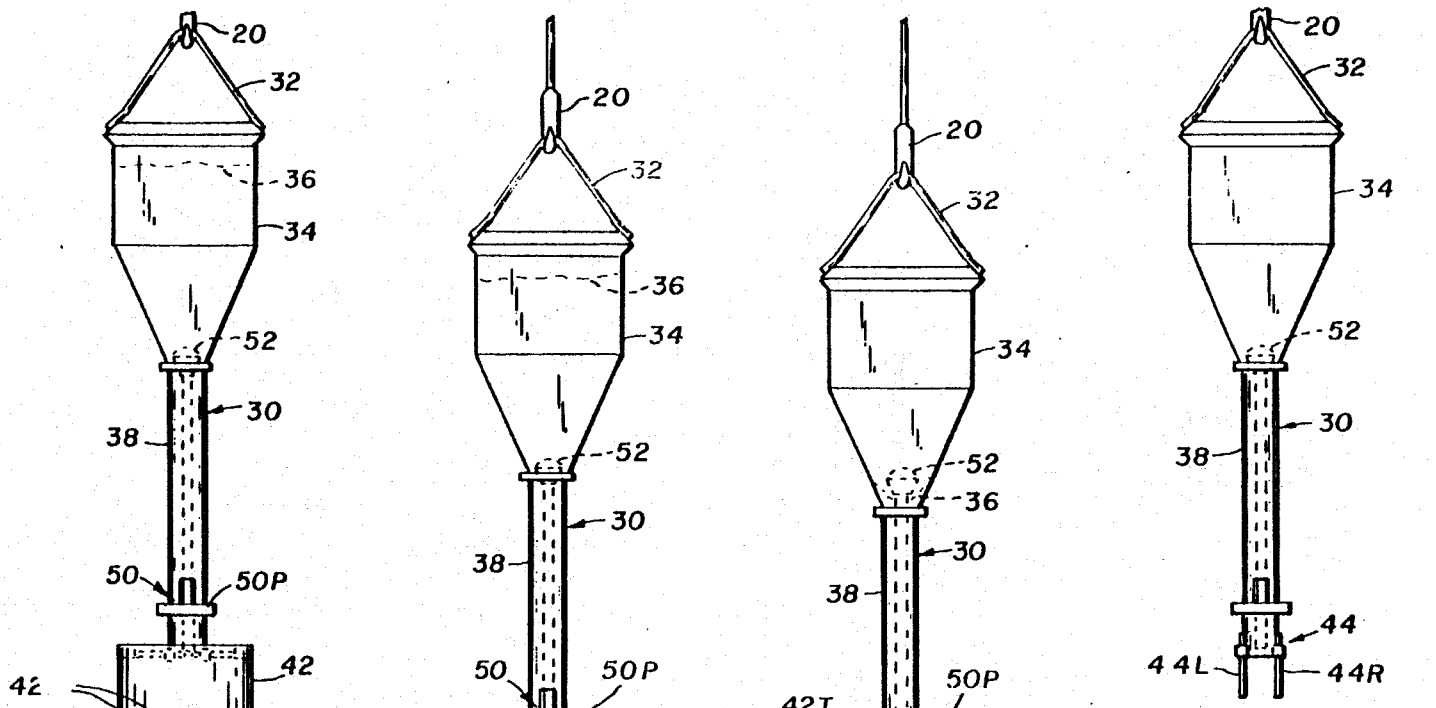
Fig. 4
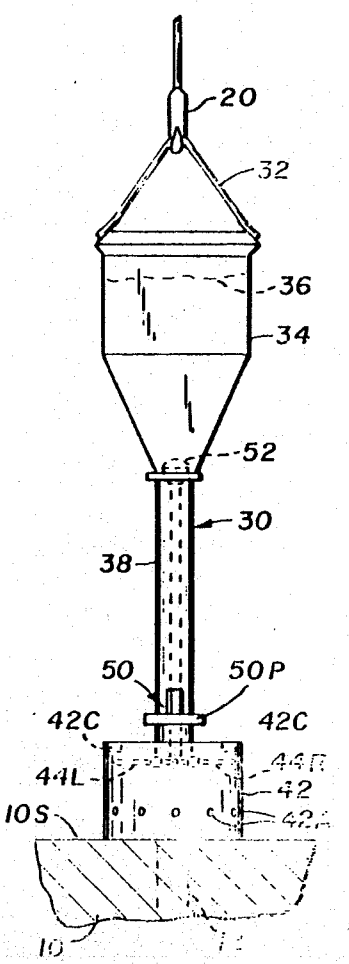
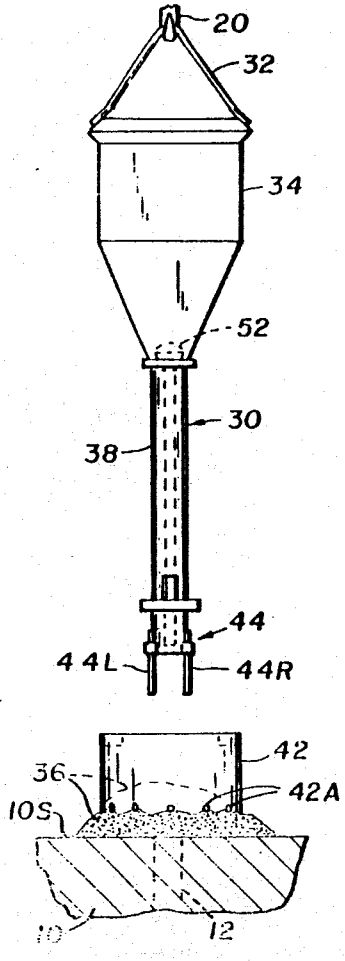
Fig. 6
Fig. 7

20
32
34
36
52
30'
38
50
50P
42
42A
42T
62
64
10
10S
12

20
32
34
36
52
30'
50P
50
62
64
68
38
42T
10S
10
12

METHOD AND APPARATUS FOR FORMING LADLE WELL BLOCKS

CROSS REFERENCE TO RELATED APPLICATION

This is a Continuation-in-Part from U. S. patent application, Ser. No. 774,090, filed on Sept. 9, 1985, in the name of the present inventor and entitled "Method and Apparatus for Forming Ladle Well Blocks", which application is now abandoned in favor of this application.

FIELD OF THE INVENTION

The present invention relates to a new and improved apparatus and method for forming well blocks in ladles, tundishes and like vessels used for holding molten metals such as molten steel.

BACKGROUND OF THE INVENTION

In steel mill operations, large ladles and like vessels are periodically charged with molten metal which is withdrawn through a well or hole formed through the thick bottom of the ladle. Such ladles are conventionally lined with a refractory material. See for example, U. S. Pat. No. 4,368,834 to Daussan et al, entitled: Preheating Device For Stopper-Type Tundishes; U.S. Pat. No. 3,944,116 to Danieli, entitled: Process And Device For Aiding In Opening The Tundish Nozzle In A Continuous Casting System; U.S. Pat. No. 3,511,261 to Bick et al, entitled: Controllable Teeming Valve For Steel-Casting Ladles; U.S. Pat. No. 4,037,762 to Ruckstuhl, entitled: Protective Nozzle For The Outlet Of A Casting Ladle; and U.S. Pat. No. 3,197,824 to Dolenic et al, entitled: Nozzle Block For Ladles.

As can be seen from several of these references and also from U.S. Pat. No. 4,116,421 to Rowe, entitled: Method Of Sealing Tapholes In A Phosphorus Furnace, it is considered desirable to block or plug up the well so that the molten metal may not immediately flow into it. This is done so that the metal will not harden in the well (cold steel splashes) nor slag pieces become wedged therein. It is also done to lessen thermal shock to the well sides. Such thermal shock may lessen the useful life of the refractory lining of the well. Commonly, the well is blocked or plugged with refractory sand, chrome sand or granular quartz, all which we will here call "sand". To prevent such sand from being blown or splashed out during preheating or upon the initial charging of the vessel, a disposable cover is sometimes placed over the sand in the well.

This sand and cover were heretofore placed into and over the well by having a workman go into the ladle (often in a cage suspended from a crane). The workman would then place the sand and cap by hand in and over the well. Now, for overall efficiency in mill operations and for energy-saving reasons, it is desirable to fill the ladle as often as possible and to keep it and its refractory lining at a high temperature. Thus, the job of so charging the well and placing a cap or cover must normally be done quickly in extremely hot and dangerous conditions. Yet, because the sand used is relatively expensive and proper placement considered of such importance, this dangerous and uncomfortable method of accomplishing this end had become the accepted practice.

SUMMARY OF THE INVENTION

The present invention overcomes one or more of the drawbacks of prior methods by providing a novel method and apparatus that may be easily and accurately controlled from a remote location to form the desired block.

Apparatus constructed in accordance with the present invention comprises a hopper for holding sand and a discharge chute connected to the hopper. The chute allows sand to flow to a discharge opening, and the apparatus includes a valve for preventing the flow of sand from the hopper and chute. Further included is a trigger mechanism for opening the valve when the chute is positioned over the well.

The invention includes a ring or like surrounding element mounted about the discharge end of the chute and which is mounted for relative movement upward when the apparatus is lowered onto a surface. Means are provided responsive to the relative movement of the ring for operating the valve.

The invention, together with the advantages thereof, may best be understood by reference to the following description taken in connection with the accompanying drawings, in the several figures of which, like reference numerals identify like elements.

BRIEF DESCRIPTION OF THE DRAWINGS

FIGS. 4 through 7 are side views of the apparatus, illustrating successive steps in the method of filling the well of a ladle (shown partly and in section), useful in illustrating the operation of the apparatus and steps in the process of forming a well block.

DETAILED DESCRIPTION OF PREFERRED EMBODIMENTS

Figure 1:
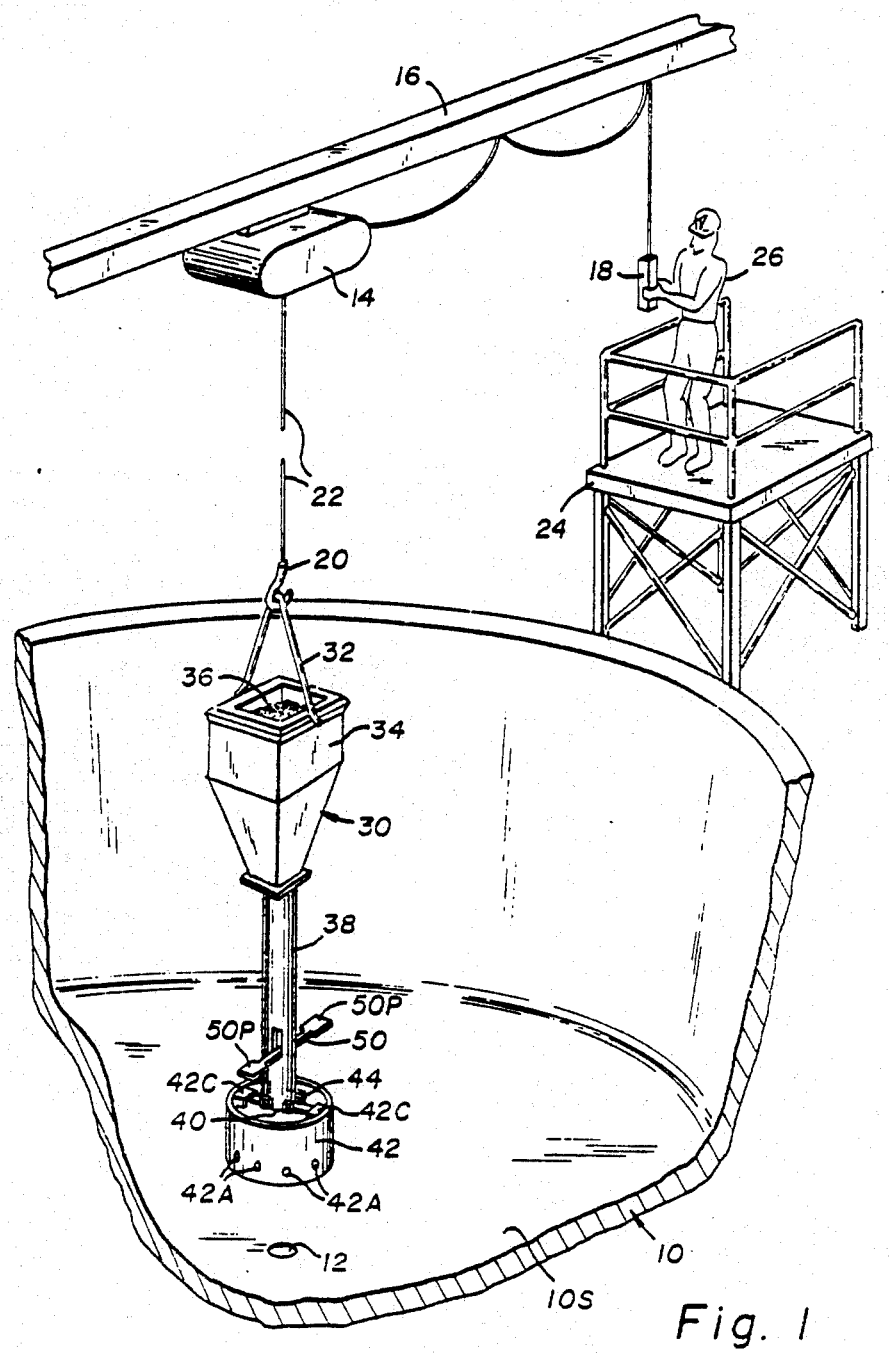
FIG. 1 is a perspective view of a portion of a steel ladle and its environment, with apparatus constructed in accordance with the present invention, shown in use by a remote operator carrying out the method of the present invention.

Referring now to FIG. 1, there is depicted a ladle 10 of the type having a well 12 through which molten steel is drained during use. A ladle in a steel mill may be approximately fourteen feet in diameter and twelve feet high, with the well 12 set approximately two feet from a wall. The well 12 will conventionally have at its bottom a sliding valve (not shown) such as shown in the aforementioned Bick et al, U.S. Pat. No. 3,511,161.

Steel mills almost always have movable overhead cranes such as the crane 14 that moves along a beam 16 in response to a control 18. The crane 14 has a hook 20 at the end of a depending chain or cable 22. This hook 20 can be selectively raised or lowered by operation of the control 18.

It is also usual for a mill to have one or more platforms 24 positioned about the ladle 10, upon which a workman 26 may stand to observe the interior of the ladle 10.

In accordance with the present invention, there is provided, and there is depicted in FIG. 1, a novel well filling apparatus generally designated 30. This apparatus 30 is suspended from the hook 20 of the crane. The apparatus 30 includes a handle 32 which is received in the hook 20 and which projects over a bin portion 34. This bin 34 is open at the top to easily receive sand 36.

The apparatus 30 includes a chute 38 through which the sand may be selectively discharged through an opening 40. Near this opening 40, a movable unit or ring in the form of a disposable and releasable can 42 which is also constructed in accordance with the present invention and which is carried on a latch mechanism 44 which will be explained in more detail below.

Mobile hoppers with a valve arrangement similar to the upper portion of the unit 30 have been known prior to the present invention. Such prior art units, however, could not discharge into a hole such as the well 12, since they employed a bottom rod to raise the valve, nor could such units carry a disposable can 42. They lacked the latch mechanism 44 and the trigger mechanism 50, could not be employed to fill such wells, and the above-described dangerous hard labor process was, prior to this invention, the standard process used.

Figure 2:
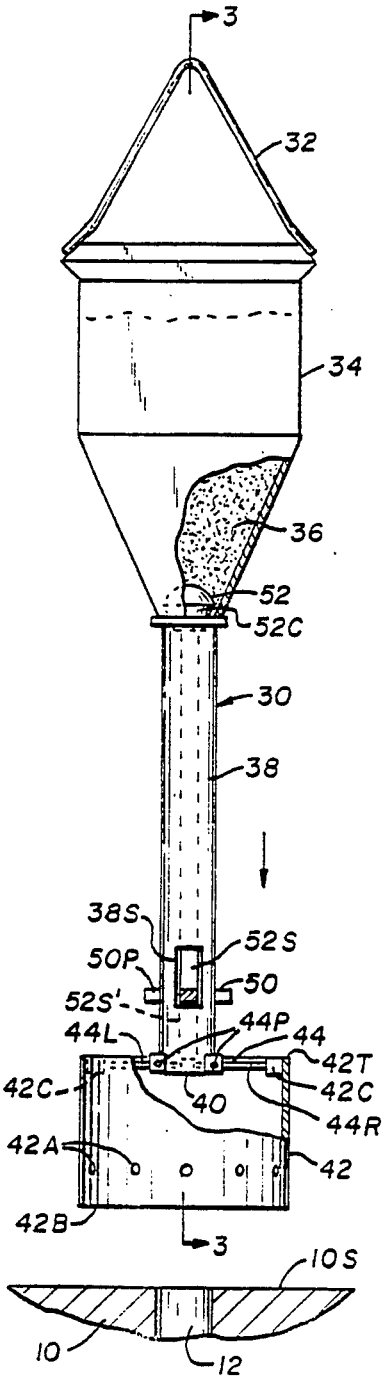
FIG. 2 is a side view of the inventive apparatus of FIG. 1, with parts broken away for clarity and to show interior construction, and with one internal part shown in phantom outline.
Figure 3:
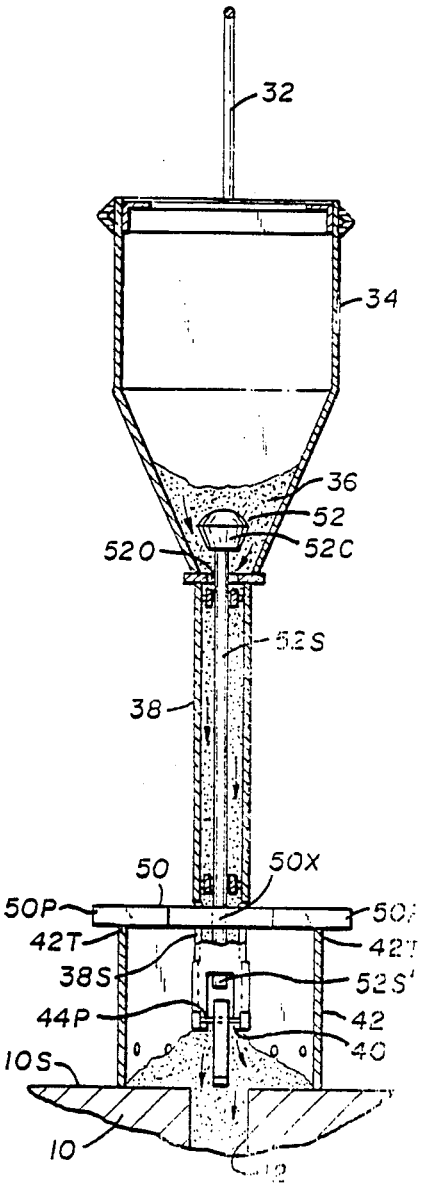
FIG. 3 is a sectional view, generally as seen from the plane defined by the line 3—3 in FIG. 2, looking in the direction of the arrows of the apparatus of FIG. 2 in a moved position, and with parts shown in moved positions.
Figure 8:
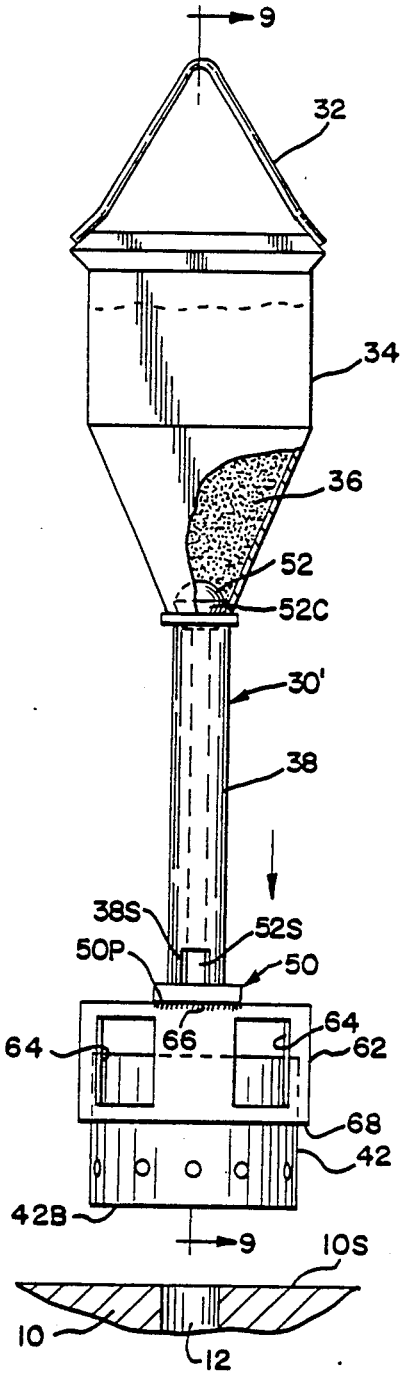
FIG. 8 is an elevational view, partly broken away and with internal parts shown in dashed outline, a second or modified embodiment of the apparatus of the present invention, in use above a ladle well.

As also depicted in FIG. 1, the trigger mechanism 50 is provided as part of the apparatus 30 for operating a valve 52 which is shown in FIGS. 2 and 3.

Referring to those figures, it can be seen the valve 52 is of the poppet type and includes a conical surface 52C which mates against a round opening 520 (FIG. 3) at the bottom of the bin 34. The valve 52 is operated by a valve stem 52S which is connected to the trigger 50. This shaft form part of the latch mechanism 44.

The latch mechanism 44 includes a pair of oppositely disposable projecting latch members 44L and 44R which are mounted to be able to freely pivot in a vertical plane at approximately the point 44P where they pass under sidewalls of the chute 38. Most of the weight of the latch members 44L and 44R being to one side of the pivot point 44P, they will, when free, tend to pivot downward to be vertically disposed. As shown in FIG. 2, however, these members 44L and 44R are latched into horizontal positions projecting outward by the end 52S' of the valve stem 52S (FIG. 2) when it is in its lowest position.

The outer ends of latches 44L, 44R receive channel sections 42C of the can 42 (as best shown in FIG. 1). These channel sections 42C are secured as by welding to the main body of the disposable can 42 and form part of it. These sections 42C loosely fit over the ends of the latches 42R, 42L so that the can 42 can rest on and be easily lifted off of the ends of the latch members 44L, 44R. The can 42 defines a plurality of apertures 42A at spaced apart array about its side surface.

The trigger 50 is a horizontal member that is secured at 50X to the shaft 52S and has two wide flat paddle sections 50P formed at either end. The member 50 projects out of vertical slots 38S formed on either side of the chute 38.

FIGS. 2 and 3 together illustrate the operation of the latch and the trigger mechanism. As the apparatus 30 is lowered on to the upper surface 10S of the vessel 10, the bottom 42B of the can 42 makes contact with the surface 10S. As the hook 20 (FIG. 1) is lowered more, the latch members 44L and 44R move out of engagement with the channel sections 42C, and the paddles 50P of the trigger mechanism contact the upper edge 42T of the can 42 (FIG. 3). As the hook 20 is lowered still more, the weight of the hopper and chute move them still lower. The downward movement of the paddles 50P is stopped by the can 42. The paddles 50P and these being rigidly connected to the stem 52S and 52S', cause the stem 52S', to move upward relative to the latch members 44L and 44R to release them and also cause the valve section 52C to rise off of the opening 520 to open the valve 52.

The effect of this is to release the can 42 from the apparatus 30 and to start the flow of sand, as indicated in FIG. 3, down the chute 38, out of the opening 40, and into the well 12.

The method of filling, capping and crowning of the well 12 using the apparatus 30 and disposable cap 42 is best appreciated from FIGS. 4 through 7 which illustrate different stages in the process. The first step is to provide the apparatus 30 on the crane 14 and to latch the members 44L and 44R outward under the stem 52S', change the hopper with sand 36 (with the valve 52 closed) and to hang a can 42 on the latch members 44L and 44R. This is done outside of the ladle 10, for example, at the platform 24 (FIG. 1). The operator 26 then employs the control 18 to raise the can 42 and apparatus 30 above the height of the rim of the vessel 10 and to move them over and into that vessel toward the well 12. This can be safely and relatively comfortably done by eye as shown in FIG. 1.

As the apparatus 30 is lowered over the well 12, the can 42 comes to rest on the surface 10S (FIG. 5) and the latch members 44R, 44L move out from engagement with the channel sections 42C.

As the apparatus 30 moves lower, the paddles 50P of the mechanism 50 come to rest on the top 42T of the can 42 (FIG. 6), and further lowering of the hook 20 results in the opening of the valve 52 and the start of the discharge of sand through the chute 38 into the can 42 and well 12. This discharge continues so as to fill the well, as shown in FIG. 6, and mound up over it. The mound of sand within the can 42 builds up until it flows out the spaced apart apertures 42A, as also shown in FIG. 6. The quantity of the original charge of sand in the bin 34 is such that this flow continues to mound up in the can 42 and to flow out of the apertures 42A to form a surrounding mound or crown about the entire outer periphery of the bottom of the can 42 (FIG. 7).

The hook 20 may now rise, carrying upward the now empty of sand apparatus 30, as shown in FIG. 7. The apparatus 30 may be moved out of the vessel 10 and prepared for reuse by re-latching the members 44L and 44R, inserting of a new can in them and re-charging of the bin 34 with a new load of sand.

Once the apparatus 30 is removed from the ladle 10, a new load of molten steel may be poured therein. The block formed by the sand 36 and can 42, as shown in FIG. 7, serves to prevent the clogging of the well 12 as well as preventing excessive wear of the lining of the well 12. The can 42, being made of steel is dissolved in the molten steel, but not before it does its job of protecting the sand 36 from being washed away from the well 12.

A working apparatus 30 and disposable can 42 both constructed substantially as depicted and described have been built and tested in actual use on steel mill ladles and have worked successfully and well. In actual use, precise alignment of the can 42 centrally over the well 12 has not proved to be necessary, it being sufficient to place the can in nearly any location substantially over the well so that sand can flow into it.

Without limiting the scope of the claims and the present invention, the following measurements and values of one version of the invention are listed as a concrete example of a suitable construction. The present inventor may, of course, based on further experiments and experience, make changes and modifications in the future invention.

The hopper 16 was fabricated of quarter-inch steel plate and was about 20 inches in height and 12 inches square at its opening. (An expanded metal grate or screen [not shown] was placed over the top of the unit to prevent any large foreign objects from entering the hopper.) The vertical walls were about half its height and the funnel shaped walls were angled at 23 degrees to the vertical. The valve seat opening 520 was formed by making a two-inch diameter round hole in a three and one-half inch square of quarter inch steel plate. The valve stopper 52C was formed of steel from a three-inch diameter bar, with the surface that mates with the hole 520 being a section of a cone whose sides are approximately 30 degrees to the vertical. This unit was welded to a one-inch steel bar approximately 20 inches long, which forms shaft 52S. The paddles 50P were each one by four and one-quarter by four and one-half inches and were connected by a one-inch square steel bar welded to the bar 52S. The extension 52S' was a one-inch square bar that was three and one-quarter inches long.

The chute 38 was formed of two and one-half inch diameter schedule 40 pipe, twenty four and one-half inches long. Two center guides formed of one-inch diameter schedule 40 pipe, one-inch long. A pair of spacers sized to fit was provided within the chute 38 to hold the guide 52S centered therein. A pair of one and one-quarter inches wide by three inches long slots in chute 38 accommodated the member 50. These slots started 3 inches above the bottom of the chute 38.

The members 44L, 44R were each formed of two pieces of ⅜ inch by 1 and ¼ inch steel, one 3 and ¾ inches long and the other 1 inch long. These were both edge-welded to a ¼ inch round two and one-half inches long bar that formed the pivot. This pivot bar was seated loosely into fitted 5/16 inch holes formed in 1 inch square ¼ inch thick members welded to the chute 38.

The can 42 was formed in a cylindrical shape of 14 gage galvanized steel, 8 inches in height and 11 inches in diameter. Twelve one-half inch diameter apertures 42A were spaced equally about the can 30 degrees apart at a spacing of approximately two and seven eighths inches apart. The apertures 42A were centered two inches above the bottom edge 42B of the can 42. The channel sections 42C were 2 inches by 1 inch by ⅛ inch channel one inch long and were welded by 1 inch by ⅛ inch channel one inch long and were welded to be flush with the top edge 42T of the can 42.

Second Embodiment

Figure 9:
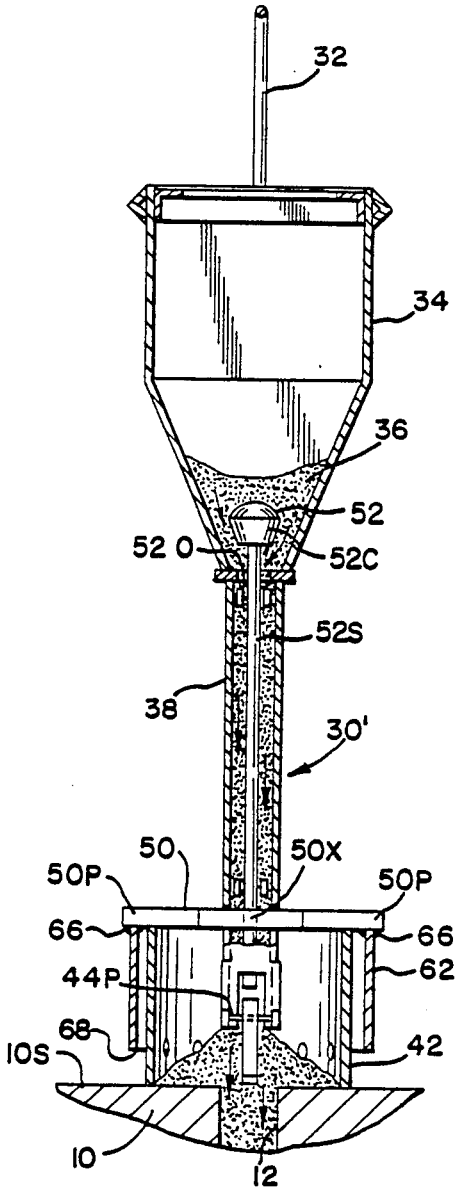
FIG. 9 is a sectional view of the apparatus of FIG. 8, as seen from the line 9—9 in that Figure, in a moved position, with parts shown in moved positions.
Figures 10, 11, 12, 13:
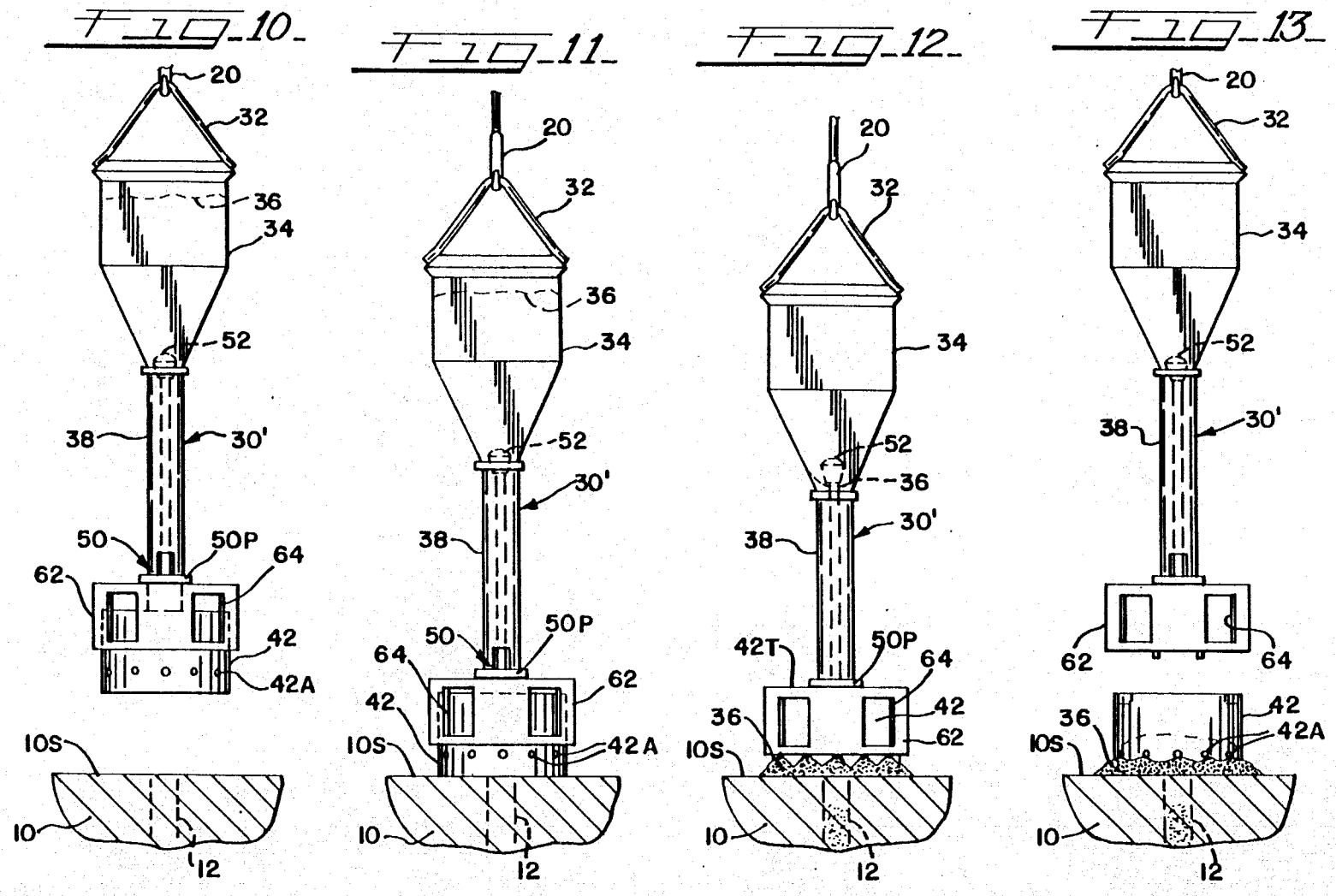
FIGS. 10 through 13 are views similar to those of FIGS. 4 through 7, illustrating successive steps in the use of the embodiment of FIGS. 8 and 9, with a disposable can.

A second embodiment is shown in FIGS. 9–17, which includes a modified apparatus 30, designated 30'. This apparatus 30' may be used with a disposable can 42, as shown in FIGS. 8 through 13, or without, as shown in FIGS. 14 through 17. The apparatus 30' is identical to that of the first embodiment, apparatus 30, except for the provision of a movable unit or ring 62 which is of a larger diameter (as best shown in FIG. 9) than that of the disposable can 42. The ring 62 has four rectilinear openings 64, spread equally about its perimeter, to aid the remotely located operator in viewing, and is shorter than the can 42, with its bottom edge 68 at all times above the bottom edge of a can 42 carried by the apparatus.

The ring 62 is welded or otherwise securely affixed at 66 to the underside of the two paddles 50P of the trigger 50.

As illustrated by FIGS. 9 through 13, this construction allows the can 42 to be secured and employed as in the previous embodiment.

Figures 14, 15, 16, 17:
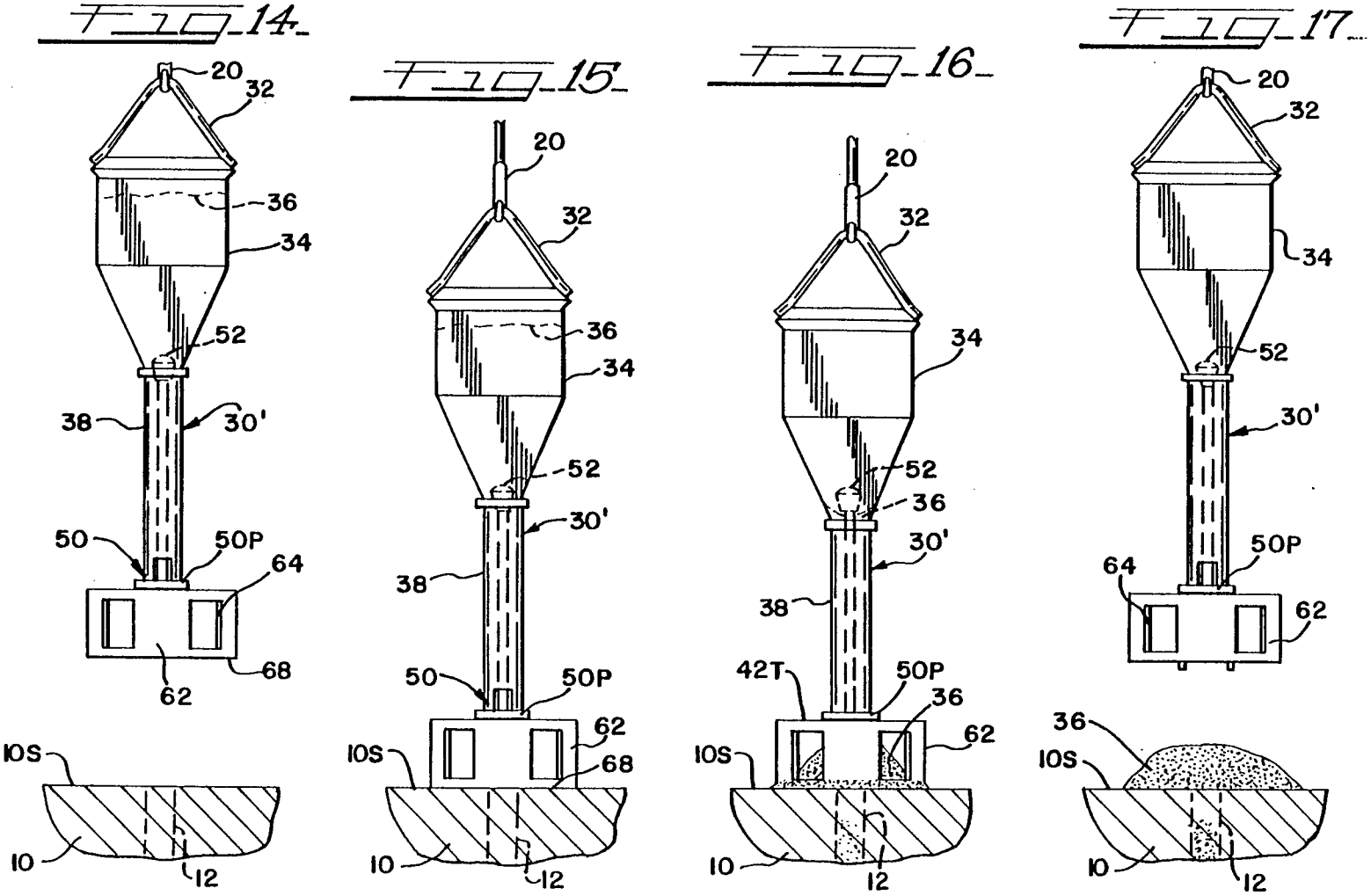
FIGS. 14 through 17 are similar views to those of FIGS. 10 through 13, illustrating successive steps in the use of the apparatus of FIGS. 8 through 14, forming a well block without a disposable can.

The apparatus 30' may, however, be used without the can, as shown in FIGS. 14 through 17. In this case the arms 44L and 44R are latched as before, but no can is placed over their ends. The hopper 34 is loaded with sand and, as shown in FIG. 14, positioned over the well 12. And, as illustrated in FIGS. 15 and 16, the apparatus is then lowered until the bottom edge 68 of the ring 62 is seated on the 20 (FIG. 16) causes the ring 62 to raise up the paddle 50P, open the poppet valve 52, and discharge the sand 36.

The ring's 62 outer bottom edge serves to hold the sand 36 about the well 12 to make sure it mounds up above the well.

While two particular embodiments of the invention have been shown and described, it will be obvious to those skilled in the art that changes and modifications may be made without departing from the invention and, therefore, the aim in the appended claims is to cover all such changes and modifications as fall within the true spirit and scope of the invention.

I claim:

1. Improved apparatus for forming a well block in a well in a vessel for holding molten metal, comprising:

a hopper sized to receive a charge of sand sufficient to at least fill the well;

a chute connected to the hopper for allowing the discharge by gravity of sand held therein and for delivering it out of a chute opening;

a valve unit for closing and opening communication between the hopper and the chute;

a movable unit mounted below and about the chute opening such that the movable unit is the lowest most projection of the apparatus, said movable unit being mounted so that it may rise up relative to the chute when the apparatus is lowered onto a surface, and being sized to fit about the well;

means responsive to the rising movement of said movable unit for operating said valve unit to open communication between the hopper and the chute.

2. The apparatus of claim 1, wherein said movable unit is a ring and is a disposable unit sized so as to fit about the well and is automatically disengaged from the rest of the apparatus upon the lowering of the apparatus onto the surface.

3. The apparatus of claim 1, wherein said movable unit is a ring and is permanently affixed to said apparatus.

4. The invention of claim 3, wherein said apparatus also includes means for receiving a disposable ring or can unit, in addition to said permanently-affixed ring, which disposable unit is sized so as to fit about the well and is automatically disengaged from the rest of the apparatus upon the lowering of the apparatus onto the surface.

5. The invention of claim 4, wherein said apparatus includes a disposable unit and wherein said disposable unit when received by said apparatus projects below said permanent ring and serves to operate said valve unit.

6. Improved apparatus for forming a well block in a well in a vessel for holding molten metal, comprising:

a hopper sized to receive a charge of sand sufficient to at least fill the well;

a chute connected to the hopper for allowing the discharge by gravity of sand held therein and for delivering it out of a chute opening;

a valve unit for closing and opening communication between the hopper and the chute;

means for operating the valve in response to the lowering of the apparatus onto a surface of the vessel about the well; and wherein said operating means includes a disposable unit that is sized so as to fit about the well and is automatically disengaged from the rest of the apparatus upon the lowering of the apparatus onto the surface.

7. The invention of claim 6, for use with a well having a predetermined volume, wherein said hopper is sized to receive a charge of sand sufficient to fill the well and mount up above it to partly fill the disengaged disposable unit with sand.

8. The invention of claim 6, wherein the apparatus includes a trigger mechanism coupled to the valve unit and projecting from the apparatus and the opening of the valve unit is triggered by the contact of said trigger mechanism with said disengaged disposable unit.

9. Improved apparatus for forming a well block in a well in a vessel for holding molten metal, comprising:

a hopper sized to receive a charge of sand sufficient to at least fill the well;

a chute connected to the hopper for allowing the discharge by gravity of sand held therein and for delivering it out of a chute opening;

a valve unit for closing and opening communication between the hopper and the chute;

means for operating the valve in response to the lowering of the apparatus onto a surface of the vessel about the well; and wherein said hopper is mounted at the top of said apparatus and includes an upward facing opening for receiving sand therein;

said hopper is of such a size as to receive a charge of sand sufficient to fill the well and also to mound up over the well;

said valve unit includes a poppet valve at the bottom of said well;

said chute extends vertically below the poppet valve;

said poppet valve is operated by a stem that is positioned to pass through the chute;

said valve operating means including a trigger mechanism projecting sideways from said stem and attached to it, said mechanism projecting out apertures formed in said chute;

a disposable can unit releasably carried by said apparatus such that the apparatus is lowered onto a surface the can makes contact with the surface first and is detached from the apparatus so that the apparatus may continue to be lowered into the can, and said trigger mechanism is so positioned as to contact the top of the can as the apparatus is lowered therein and by raising the stem relative to the chute to open the poppet valve and start the discharge of sand through the chute.

10. The invention of claim 9, wherein said disposable unit is carried by a pair of projecting arms which project from the chute and the contact of said trigger mechanism with said disposable unit also serves to lower said pair of arms.

11. A process of forming a well block for a well in a vessel for holding molten metal using an overhead crane whose position may be moved and a hook may be raised and lowered using a remote control unit and also using a hopper apparatus having a trigger for opening its discharge chute comprising the steps of:

(a) charging the hopper apparatus with a load of sand sufficient at least to fill the well, (b) using the overhead crane more by operating the remote control unit from a location outside of the vessel, the hopper unit to a position just above the well and (c) operate the trigger to open the discharge chute and discharge the sand into the well.

* * * * *

UNITED STATES PATENT OFFICE
CERTIFICATE OF CORRECTION

Patent No. 4,715,585 Dated December 29, 1987

Inventor(s) Joseph Simko

It is certified that error appears in the above-identified patent and that said Letters Patent are hereby corrected as shown below:

ABSTRACT - Line 5: Delete "and" and substitute --sand--

Signed and Sealed this

Thirtieth Day of August, 1988

*Attest:*

DONALD J. QUIGG

*Attesting Officer*

*Commissioner of Patents and Trademarks*